US006622596B2

(12) United States Patent
Janusz et al.

(10) Patent No.: US 6,622,596 B2
(45) **Date of Patent: *Sep. 23, 2003**

(54) SPRING LOADED DRIVE GUN

(75) Inventors: Michael Janusz, Elgin, IL (US); David C. Goss, Rockford, IL (US)

(73) Assignee: Textron Inc., Providence, RI (US)

( * ) Notice: Subject to any disclaimer, the term of this patent is extended or adjusted under 35 U.S.C. 154(b) by 217 days.

This patent is subject to a terminal disclaimer.

(21) Appl. No.: 09/815,809

(22) Filed: Mar. 23, 2001

(65) Prior Publication Data

US 2001/0035073 A1 Nov. 1, 2001

Related U.S. Application Data

(60) Provisional application No. 60/192,866, filed on Mar. 29, 2000.

(51) Int. Cl.[7] ..... B25B 23/06

(52) U.S. Cl. ..... 81/57.37; 173/30

(58) Field of Search ..... 81/57.37, 431, 81/432, 433, 434, 435; 173/11, 13, 18, 29, 30, 170; 227/119, 139, 142

(56) References Cited

U.S. PATENT DOCUMENTS

| | | | | | |
|---|---|---|---|---|---|
| 480,530 | A | * | 8/1892 | Tobey | 81/435 |
| 1,499,887 | A | * | 7/1924 | Snyder et al. | 81/430 |
| 1,624,189 | A | * | 4/1927 | Steen | 81/433 |
| 2,723,835 | A | | 11/1955 | Reese et al. | 255/19 |
| 3,279,045 | A | * | 10/1966 | Dixon | 29/809 |
| 3,802,517 | A | | 4/1974 | Cooke-Yarborough | 173/18 |
| 3,960,191 | A | | 6/1976 | Murray | 81/57.37 |
| 4,236,555 | A | | 12/1980 | Dewey | 81/431 |
| 4,246,939 | A | | 1/1981 | Boegel | 29/771 |
| 4,295,394 | A | * | 10/1981 | DeCaro | 81/57.37 |
| 4,354,403 | A | | 10/1982 | Boëgel et al. | 81/57.37 |
| 4,397,412 | A | | 8/1983 | Dewey | 227/119 |
| 4,402,369 | A | | 9/1983 | Nikitin et al. | 173/18 |
| 5,058,464 | A | * | 10/1991 | McGovern et al. | 81/57.41 |
| 5,199,625 | A | | 4/1993 | Dewey et al. | 227/8 |
| 5,605,423 | A | | 2/1997 | Janusz | 411/387 |
| 5,897,045 | A | | 4/1999 | Olvera et al. | 227/119 |
| 5,921,454 | A | | 7/1999 | Larson et al. | 227/18 |
| 6,296,064 | B1 | * | 10/2001 | Janusz et al. | 173/30 |

OTHER PUBLICATIONS

Product Sheet by SFS Stadler, Inc., available at least as early as Dec. 28, 1999.

International Search Report issued Apr. 11, 2001 in connection with a related PCT patent application.

* cited by examiner

*Primary Examiner*—Joseph J. Hail, III
*Assistant Examiner*—David B. Thomas
(74) *Attorney, Agent, or Firm*—Texler, Bushnell, Giangiorgi, Blackstone & Marr, Ltd.

(57) ABSTRACT

A drive tool which does not require any upper-body force from an operator to install a fastener. The drive tool includes a top portion which is engageable with a drive source and a lower portion which is engageable with a fastener. The drive tool includes springs which are configured to urge the lower portion and upper portion of the tool away from each other (i.e. relative movement) and provide that a generally axial force is applied to the fastener engaged with the lower portion of the tool. As a result, the operator does not need to apply any upper-body axial force to the drive tool to install the fastener. Preferably, the lower portion of the drive tool includes one or more foot pads on which an operator may stand, and the spring(s) become compressed when the operator stands on the foot pad(s). As a result of the spring(s) trying to expand, a generally axial force is applied to the fastener engaged with the lower portion of the tool, thereby reducing the amount of upper-body axial force an operator must apply to the drive tool to install the fastener. Hence, the operator can use his or her own body weight to apply an axial load during a drilling operation, and need not use any upper-body force.

21 Claims, 12 Drawing Sheets

SPRING LOADED DRIVE GUN

RELATED APPLICATION

This application claims the benefit of U.S. Provisional Application Serial No. 06/192,866, filed Mar. 29, 2000.

BACKGROUND

The present invention relates generally to drive tools for installing fasteners, and relates more specifically to a drive tool which does not require any upper-body force from an operator to install a fastener.

Typically (and definitely with regard to self-drilling, self-tapping fasteners), when an operator uses a drive tool, such as a drill, to drive a fastener into a work piece, the operator must use his upper-body strength to apply an axial force to the drive tool. It is advantageous to reduce the amount of upper-body strength an operator must apply to a drive tool to effect the installation of a fastener because doing so reduces the fatigue and physical stress experienced by the operator. This is especially true because oftentimes a large number of fasteners must be installed to complete a job.

Some drive tools are configured such that, if an operator wishes to use the drive tool to install a fastener into a floor, the operator must get on the floor, on his or her knees, in order to use the drive tool to drive the fastener into the floor. Of course, getting on one's knees every time one installs a fastener in a floor can be uncomfortable and tedious. This is especially true in the case where a large number of fasteners must be installed over a large floor surface area.

Other drive tools, such as those which are disclosed in U.S. Pat. Nos. 3,960,191; 4,236,555; and 5,897,045 are configured such that an operator can remain standing while using the drive tool to install fasteners into a floor. Such drive tools are essentially extended tools connected to a power drill or to some other driving source. Typically, the drive tool is configured such that fasteners are automatically fed to the end of the drive tool. This provides that the operator can use the drive tool to install a plurality of fasteners without having to bend over each time to place a fastener at the end of the tool. Unfortunately, such drive tools are typically relatively heavy and the operator must apply substantial upper-body effort to apply the necessary axial force to the drive tool to install a fastener. Therefore, using such a drive tool, especially if an operator must use the drive tool everyday for extended periods of time, can be tiring.

OBJECTS AND SUMMARY

Accordingly, it is an object of an embodiment of the present invention to provide a drive tool which does not require any upper-body force from an operator to install a fastener.

Another object of an embodiment of the present invention is to provide a drive tool configured such that an operator can easily use his or her own body weight to apply an axial load during a drilling operation.

Briefly, and in accordance with one or more of the foregoing objects, an embodiment of the present invention provides a drive tool having a top portion which is engageable with a drive source, such as a drill, and a lower portion which is engageable with a fastener. The drive tool includes springs which are configured to urge the lower portion and upper portion of the tool away from each other (i.e. relative movement) and provide that a generally axial force is applied to the fastener engaged with the lower portion of the tool. As a result, the operator does not need to apply any upper-body axial force to the drive tool to install the fastener.

Preferably, the lower portion of the drive tool includes one or more foot pads on which an operator may stand, and the spring(s) become compressed when the operator stands on the foot pad(s). As a result of the spring(s) trying to expand under compression, a generally axial force is applied to the fastener engaged with the lower portion of the tool, thereby reducing the amount of upper-body axial force an operator must apply to the drive tool to install the fastener. Hence, the operator can use his or her own body weight to apply an axial load during a drilling operation, and need not use any upper-body force.

BRIEF DESCRIPTION OF THE DRAWINGS

The organization and manner of the structure and function of the invention, together with further objects and advantages thereof, may be understood by reference to the following description taken in connection with the accompanying drawings, wherein.

DESCRIPTION

Figure 1:
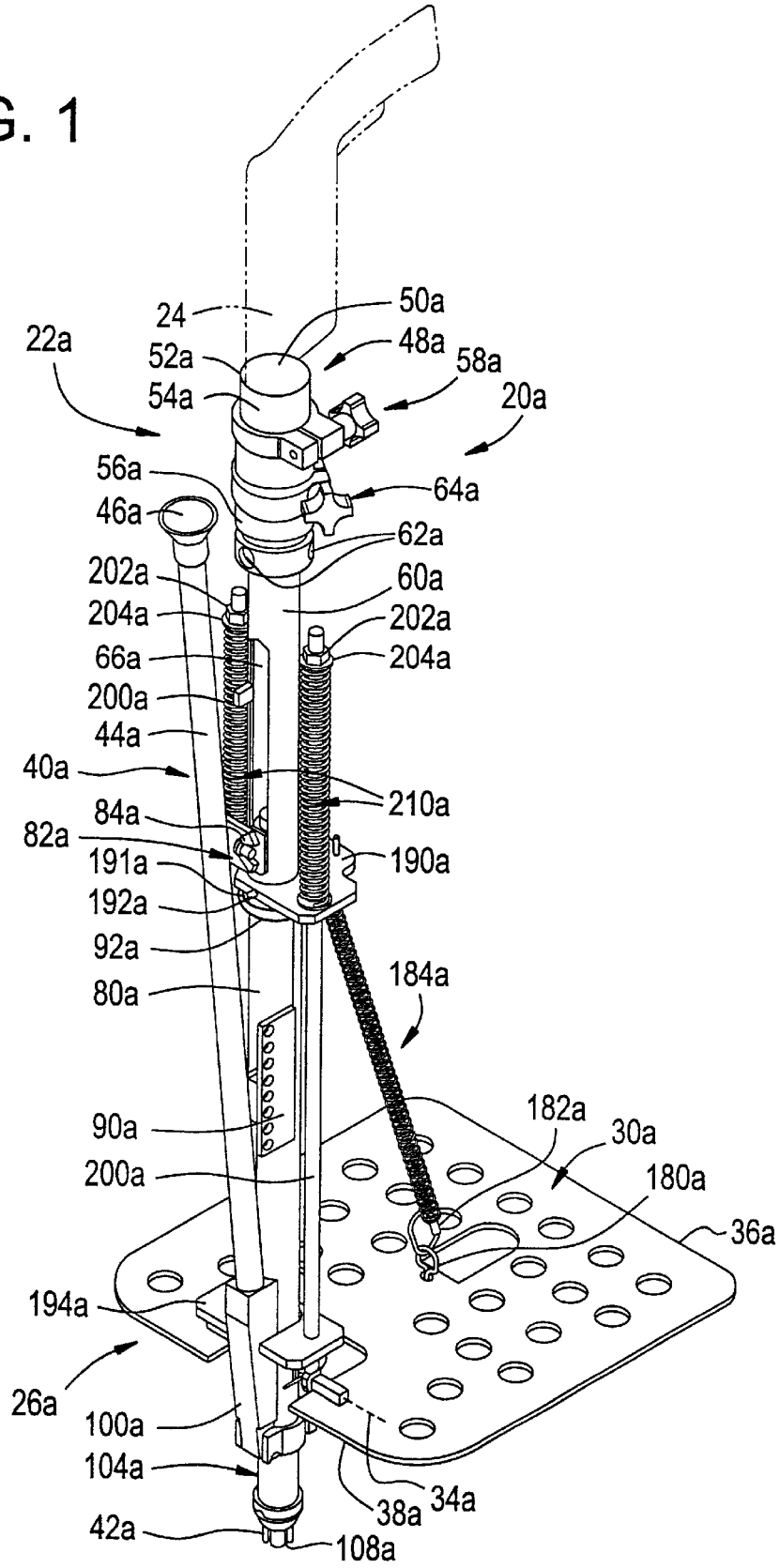
FIG. 1 is a perspective view of a drive tool in accordance with an embodiment of the present invention, showing (in phantom) a drill engaged with the drive tool.

While the present invention may be susceptible to embodiment in different forms, there are shown in the drawings, and herein will be described in detail, embodiments of the invention with the understanding that the present description is to be considered an exemplification of the principles of the invention and is not intended to limit the invention to that as illustrated and described herein.

Figure 2:
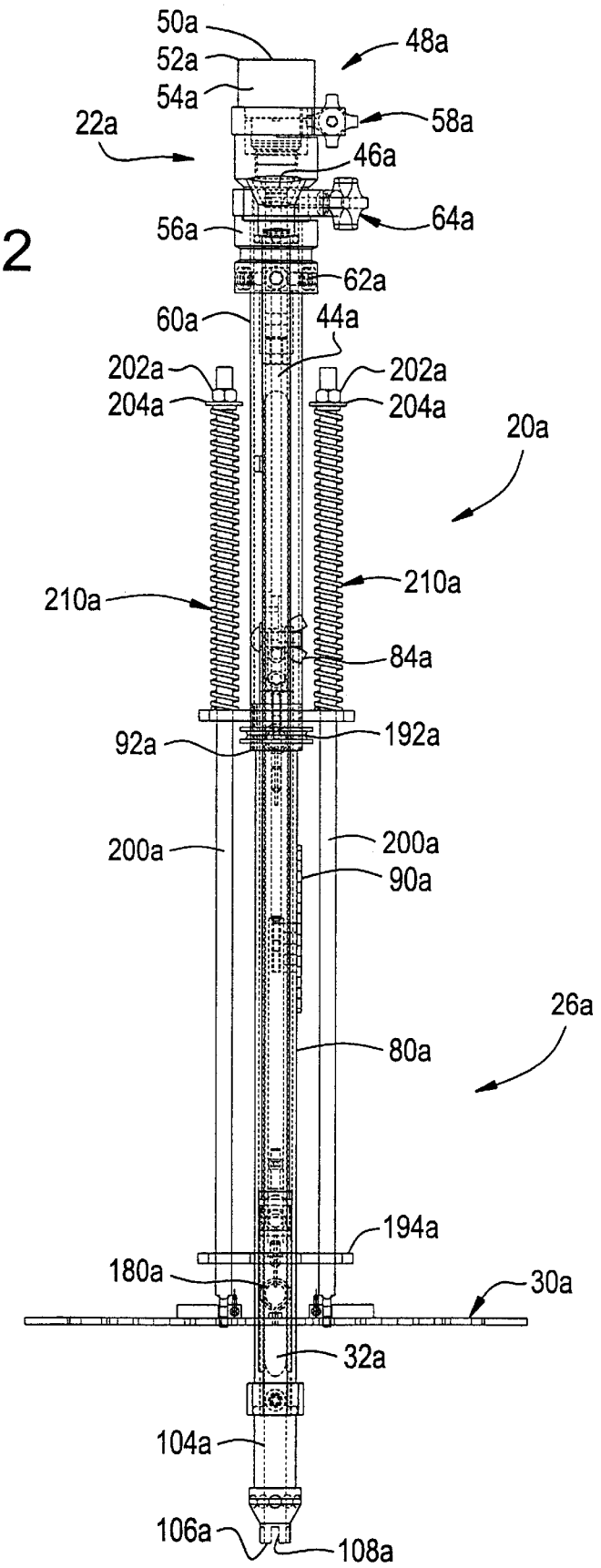
FIG. 2 is a front elevational view of the drive tool illustrated in FIG. 1.
Figure 3:
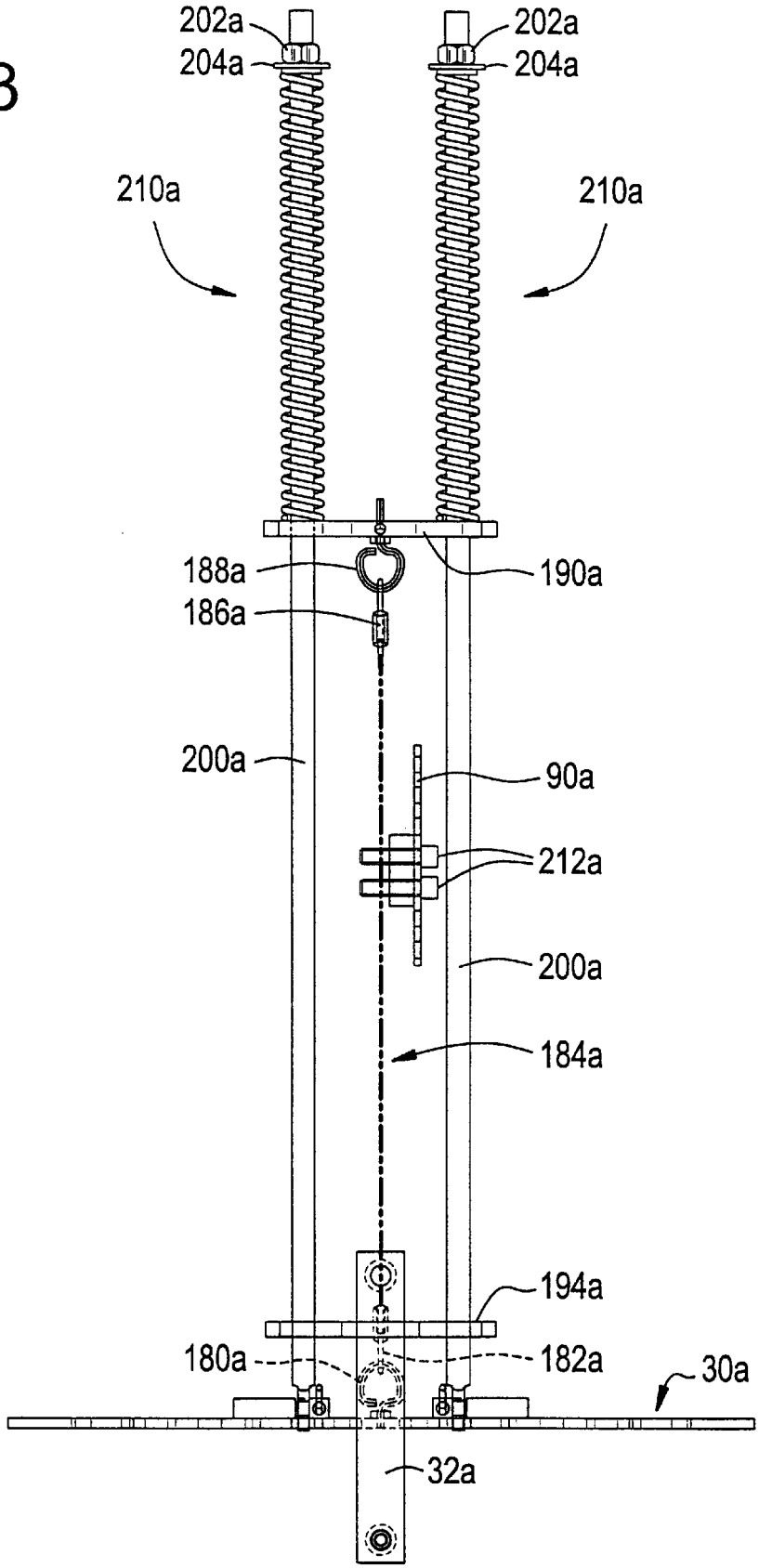
FIG. 3 is a front elevational view similar to FIG. 2, but omitting portions of the drive tool for clarity.
Figure 4:
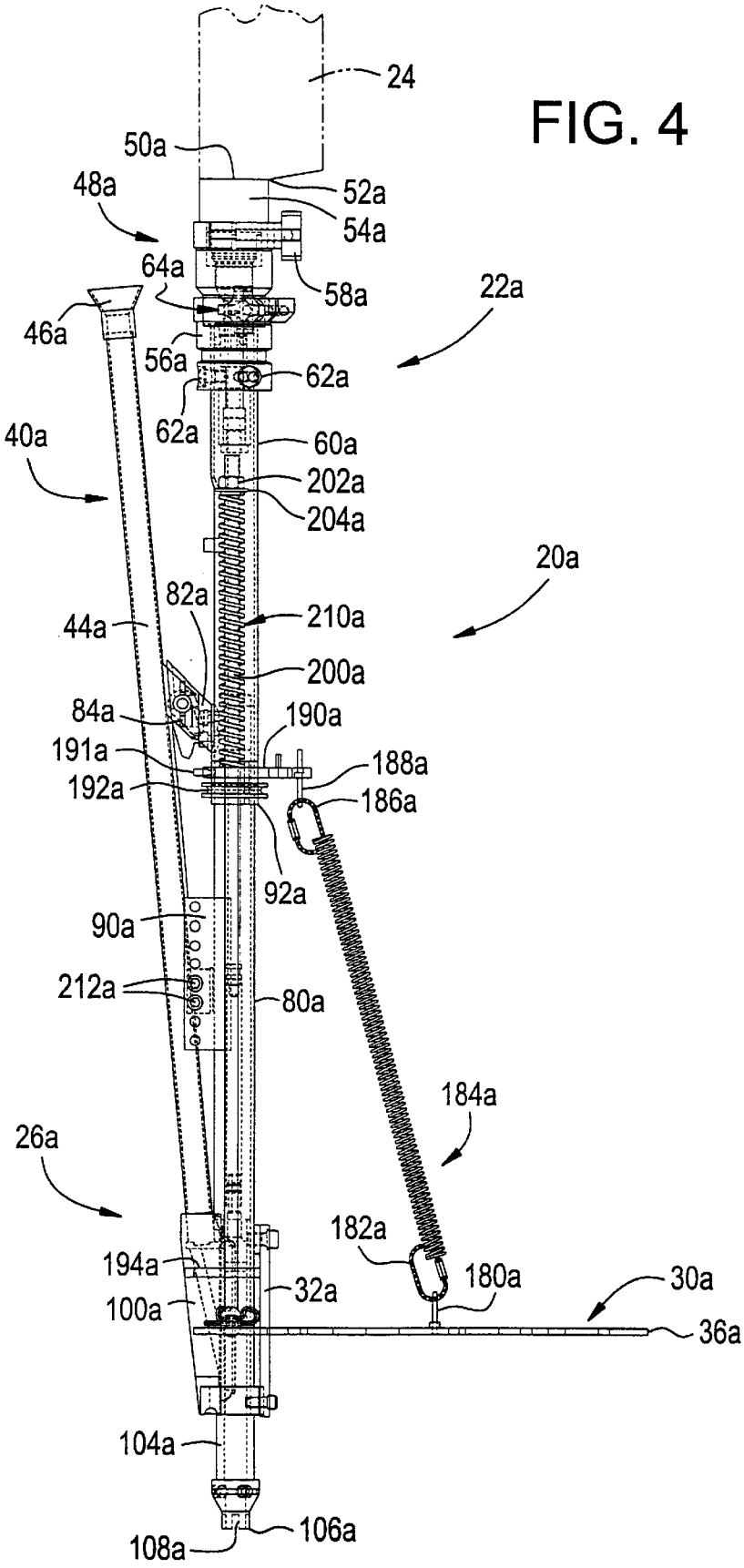
FIG. 4 is a side elevational view of the drive tool illustrated in FIGS. 1 and 2, showing (in phantom) the drill engaged with the drive tool.
Figure 5:
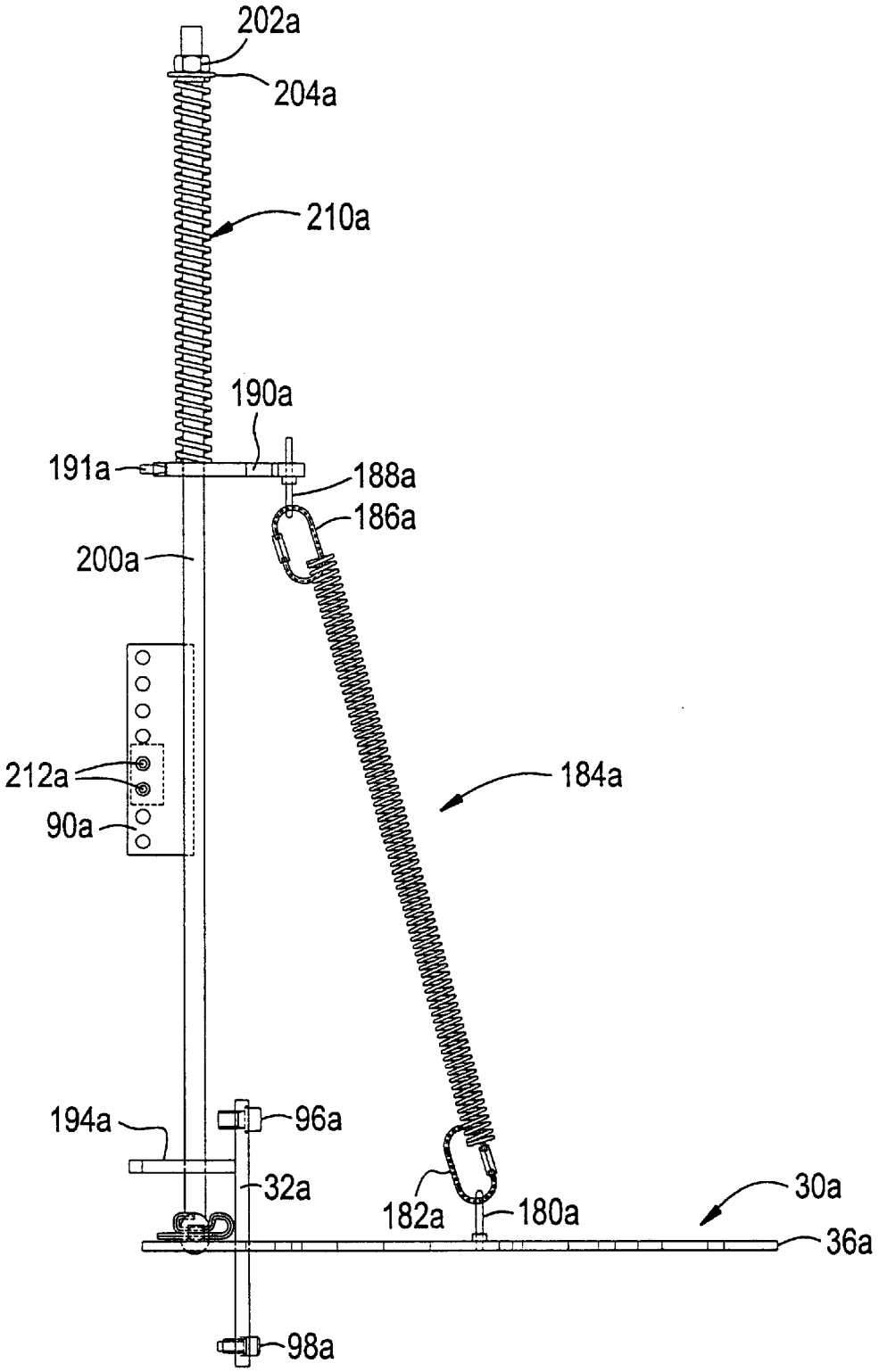
FIG. 5 is a side elevational view similar to FIG. 4, but omitting portions of the drive tool for clarity.
Figure 11:
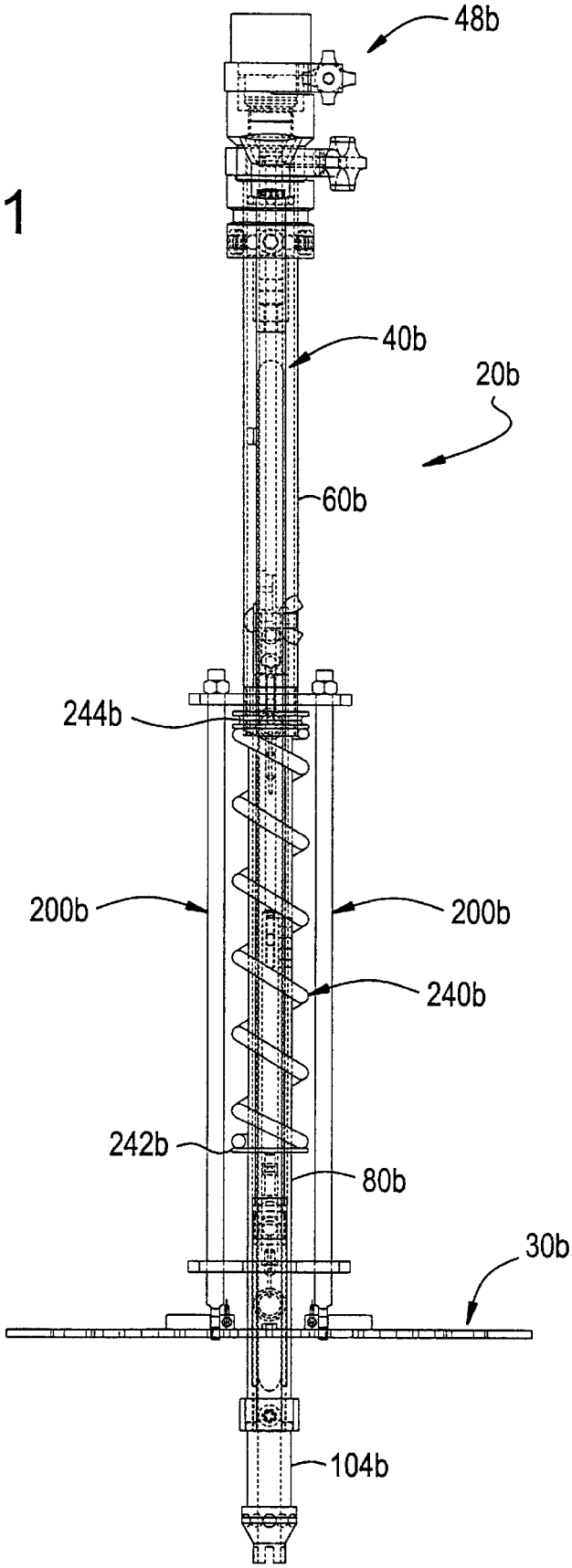
FIG. 11 is a front elevational view of a drive tool in accordance with another embodiment of the present invention.
Figure 12:
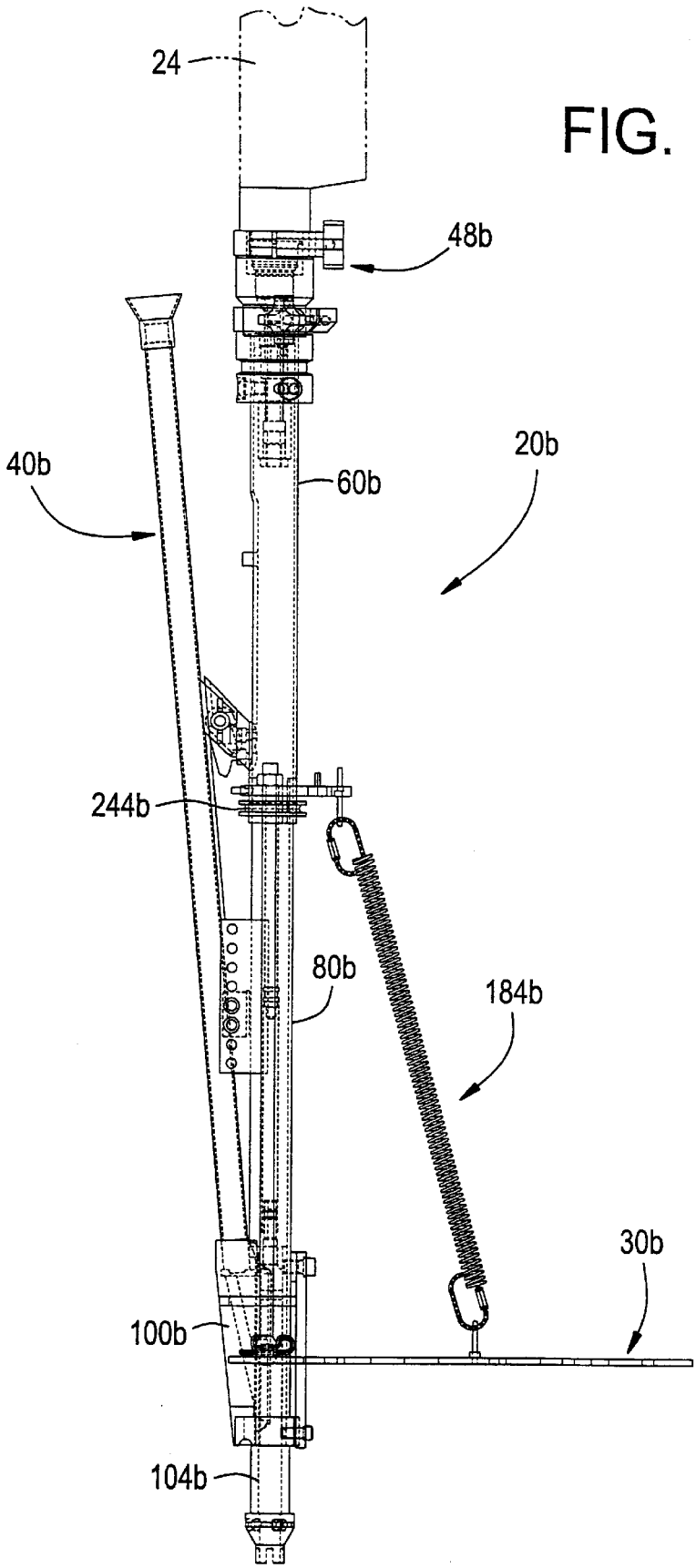
FIG. 12 is a side elevational view of the drive tool illustrated in FIG. 11, showing (in phantom) a drill engaged with the drive tool.

Shown in the FIGURES are two drive tools 20*a* and 20*b* each of which is in accordance an embodiment with the present invention. Specifically, FIGS. 1, 2 and 4 illustrate a drive tool 20*a* in accordance with a first embodiment of the present invention, and FIGS. 11 and 12 illustrate a drive tool 20*b* in accordance with a second embodiment of the present invention. Each drive tool 20*a*, 20*b* is configured such that an operator can use the drive tool 20*a*, 20*b* to drive a fastener into a work piece without having to use a substantial amount of upper-body force.

The drive tool 20*a* shown in FIGS. 1, 2 and 4 will be described first, and then the drive tool 20*b* shown in FIGS. 11 and 12 will be described. In the following description, like reference numerals are used to identify like parts, and different alphabetic suffixes (i.e., "a" and "b") are used for each of the different embodiments. At times, a detailed description of a part is omitted with the understanding that one may review the description relating to a corresponding part of the other embodiment.

Figure 10:
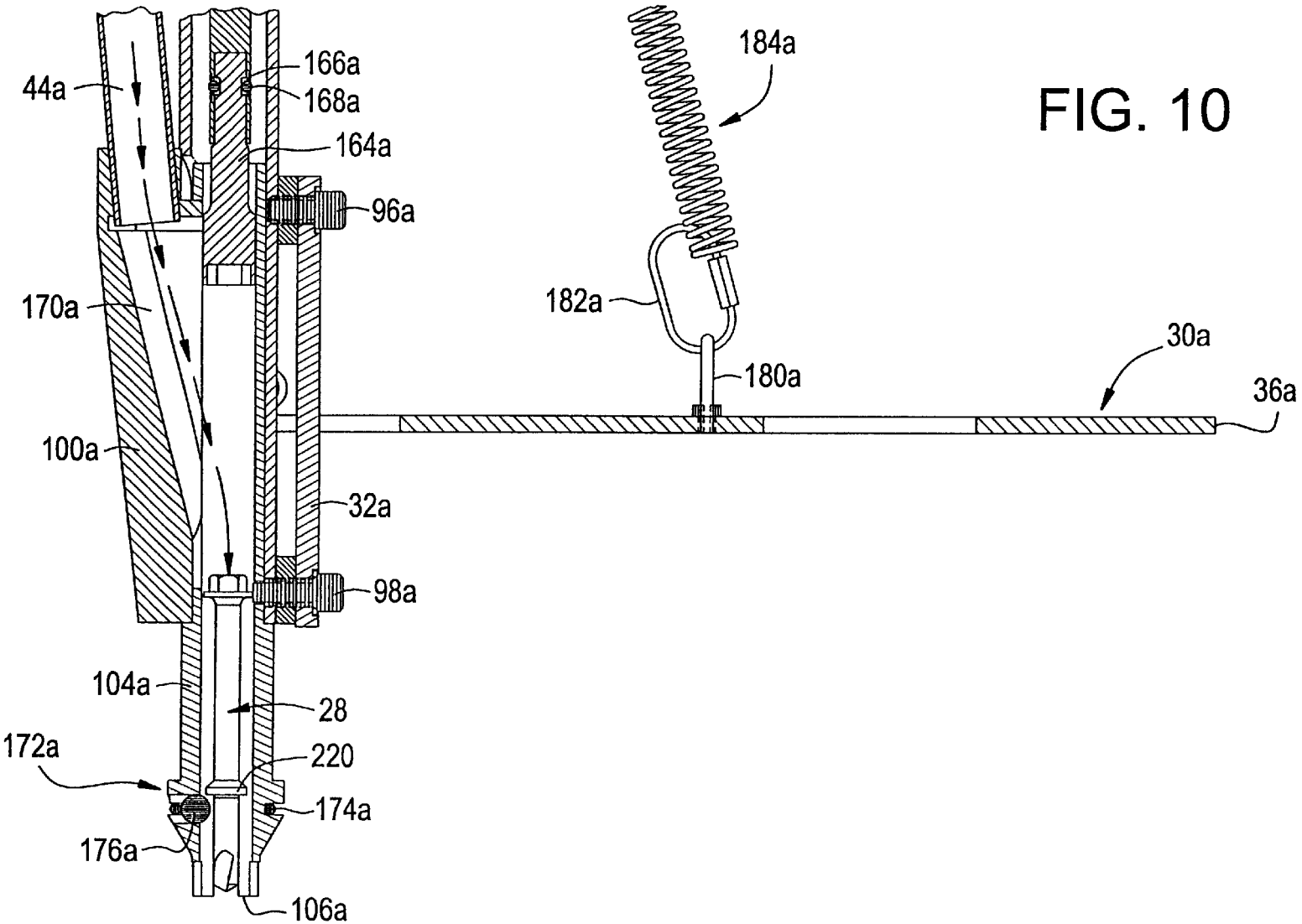
FIG. 10 is a cross-sectional view of the drive tool illustrated in FIGS. 1–5, taken along line 10—10 of FIG. 2.

The drive tool 20*a* shown in FIGS. 1, 2 and 4 includes an upper end 22*a* which is configured for engagement with a drive source 24 (see FIGS. 1, 4 and 7, wherein the drive source 24 is shown in phantom), such as with a power drill, and includes a lower end 26*a* which is configured to receive a fastener 28 (see FIG. 10). The drive tool 20*a* provides that an operator can engage the drive source 24 with the upper end 22*a* of the drive tool 20*a*, and operate the drive source 24 to cause the drive tool 20*a* to drive the fastener 28 into a work piece, without the operator having to use a substantial amount of upper-body force.

Figure 6:
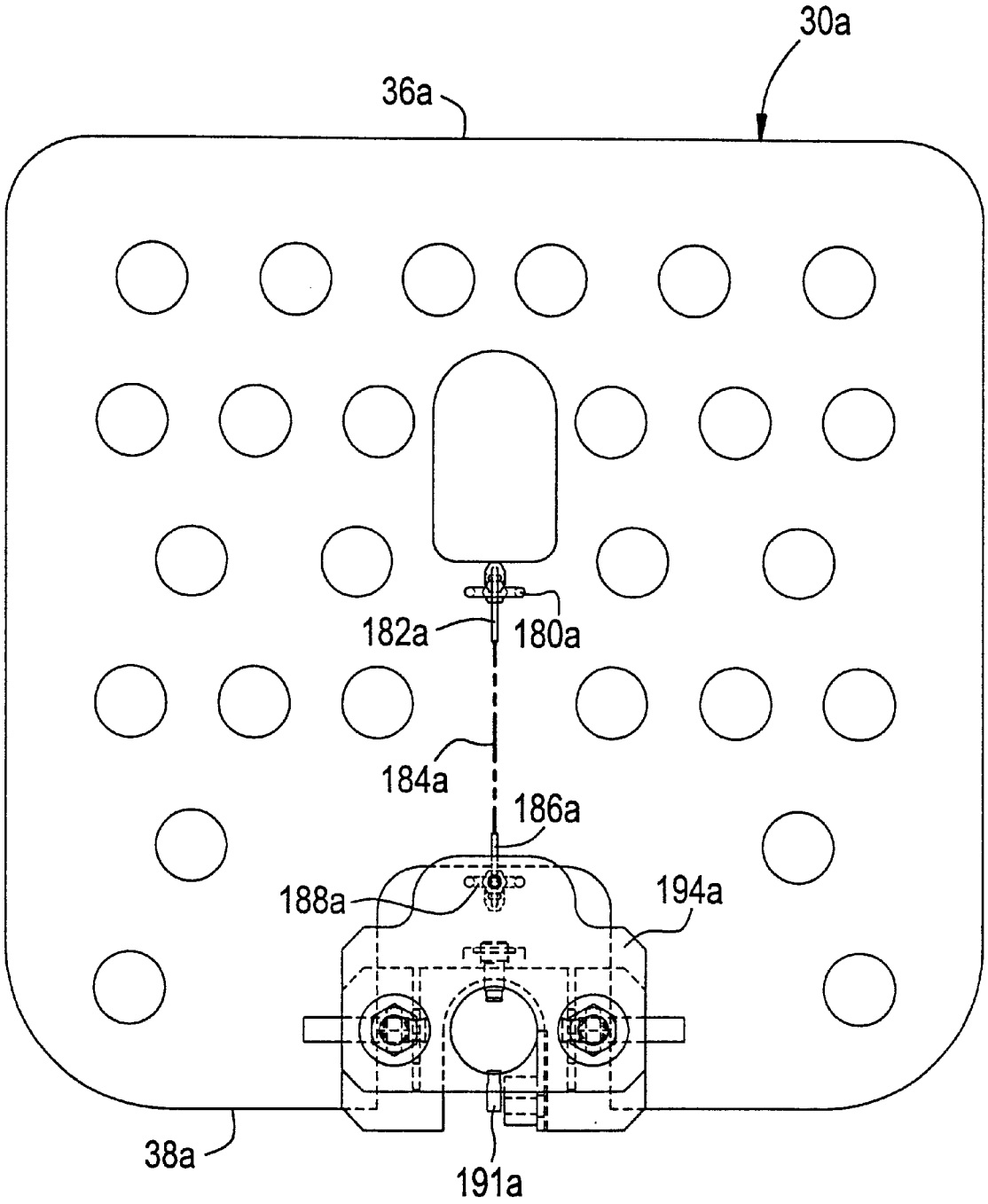
FIG. 6 is a top plan view of a foot pad of the drive tool illustrated in FIGS. 1–5.

As shown in FIGS. 1–5 and 10, the drive tool 20*a* preferably includes a foot pad 30*a* on which the operator can stand when operating the drive tool 20*a* (the foot pad 30*a* is shown generally isolated in FIG. 6). As a result, the operator can use his or her own body weight to apply an axial load to the fastener 28 while using the drive tool 20*a* to drive the fastener 28 into a work piece.

Preferably, the foot pad 30*a* extends from a bracket 32*a* which is attached to the lower end 26*a* of the drive tool 20*a*, and the foot pad 30*a* is pivotable about an axis 34*a* (see FIG. 1). Preferably, the foot pad 30*a* is pivotable such that when an operator stands on the foot pad 30*a*, an outer edge 36*a* of the foot pad 30*a* pivots downward (i.e., the foot pad 30*a* pivots about axis 34*a*) and contacts the floor. Incidentally, the other edge 38*a* of the foot pad 30*a* drops down close to the floor, but preferably does not touch the floor. This arrangement of having the axis 34*a* down by the end 42*a* of the tool 20*a*, allows the tool 20*a* to have a fulcrum point close to the floor. This results in the tool 20*a* having, effectively, a maximum amount of freedom to pivot in any direction. Pivoting is important to allow the operator to accommodate an uneven floor surface or other obstruction. In addition, the foot pad 30*a* provides that an operator can place both feet on the foot pad 30*a*, thereby maintaining his or her balance, and allows the operator to step one foot at a time on the foot pad 30*a*.

The foot pad 30*a* may also be configured such that the foot pad 30*a* can be pivoted upward into a non-operating position, and can be pivoted downward into an operating position (which is shown in the FIGURES). As will be described more fully later herein, preferably the foot pad 30*a* is spring-connected to a higher portion of the drive tool 20*a* so that the foot pad 30*a* does not tend to drop down between installations.

Although not shown, the drive tool 20*a* may include handles extending outwardly from the upper end 22*a* of the drive tool 20*a*. The handles would allow an operator to readily grip the drive tool 20*a* during use. The handles would also facilitate transportation of the drive tool 20*a*, such as the transportation of the drive tool 20*a* at a given job site, as well as the transportation of the drive tool 20*a* from one job site to another.

Preferably, as shown in FIGS. 1, 2, 4 and 7–10, an automatic fastener feeding mechanism 40*a* is in communication with the lower end 26*a* of the drive tool 20*a*. The automatic fastener feeding mechanism 40*a* is preferably configured to automatically feed fasteners 28 to the end 42*a* of the drive tool 20*a* so that an operator need not bend over and engage a fastener with the end 42*a* of the drive tool 20*a* each time the drive tool 20*a* is to be used to drive a fastener 28 into a work piece.

As shown, the automatic fastener feeding mechanism 40*a* may comprise a gravity feed tube 44*a* that includes a funnel end piece 46*a* to facilitate the deposit of fasteners 28 into the feed tube 44*a*. As such, the feed tube 44*a* essentially functions as a conduit between the standing operator and the end 42*a* of the drive tool 20*a*. Alternatively, the automatic fastener feeding mechanism 40*a* may comprise a magazine feed tube or a cartridge feeder.

As shown in FIGS. 1, 2, 4 and 7, the upper end 22*a* of the drive tool 20*a* includes a housing 48*a*. The housing 48*a* includes an opening 50*a* at an end 52*a* thereof for receiving the drive source 24 (see FIGS. 1, 4 and 7), such as for receiving the driven, rotating portion of a power drill. The housing 48*a* may include an upper portion 54*a* which provides the opening 50*a*, and a lower portion 56*a* to which the upper portion 54*a* is secured (said securement including adjustable clamp 58*a*—see FIGS. 1, 2 and 4). Alternatively, the housing 48*a* can be provided as a single piece, effectively incorporating upper portion 54*a* and lower portion 56*a*.

Figure 7:
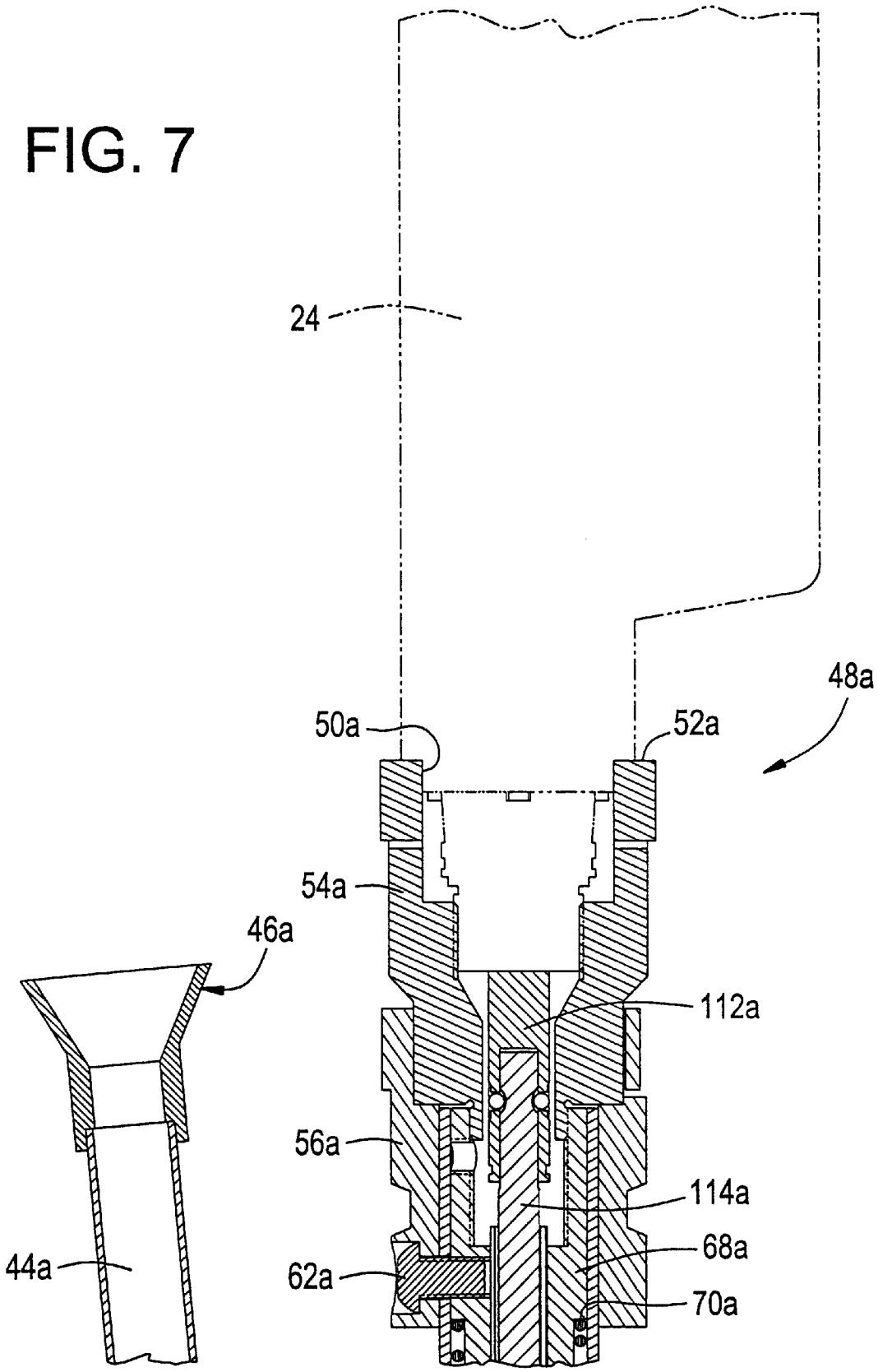
FIG. 7 is a cross-sectional view of the drive tool illustrated in FIGS. 1–5, taken along line 7—7 of FIG. 2, showing (in phantom) a drill engaged with the drive tool.
Figure 8:
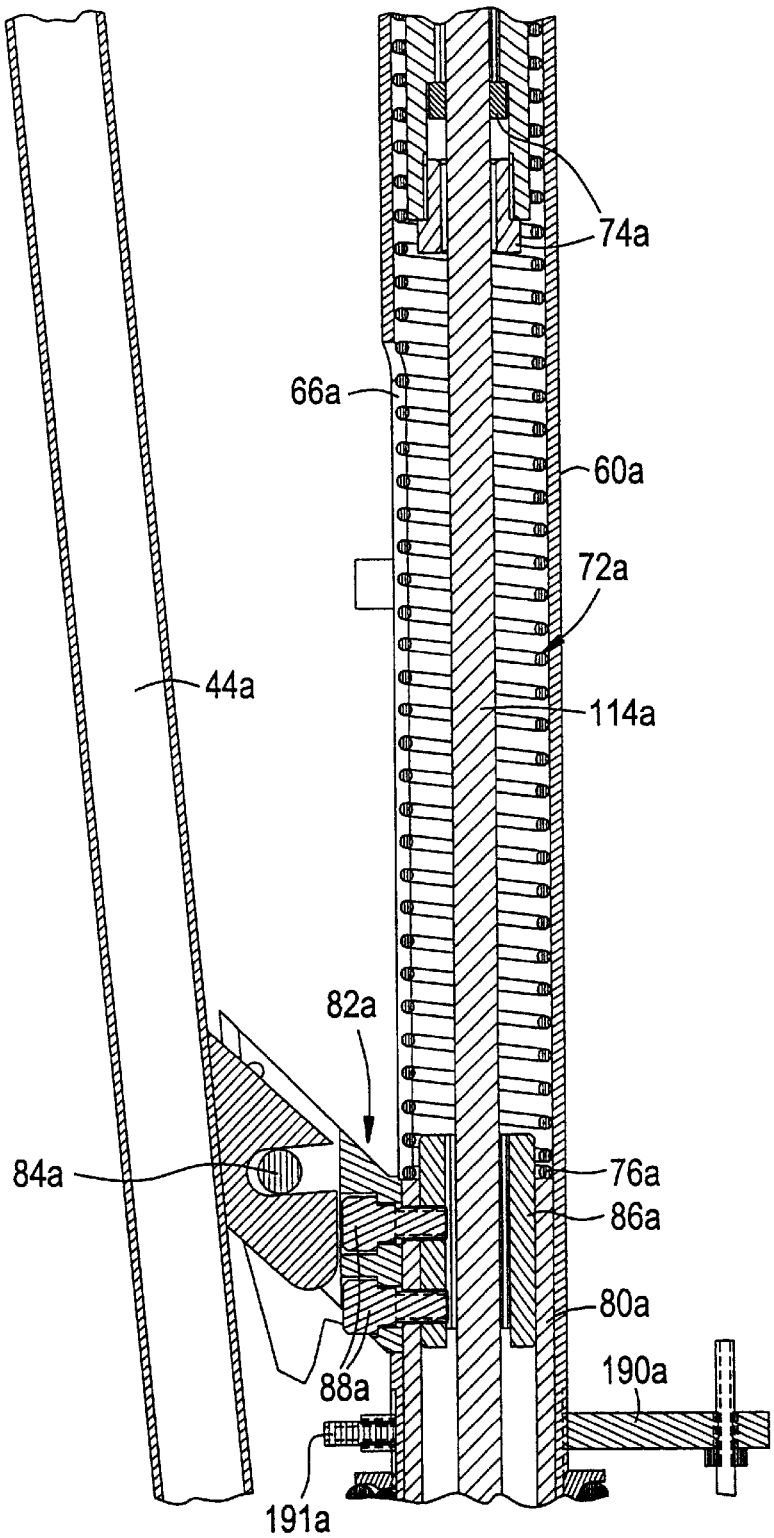
FIG. 8 is a cross-sectional view of the drive tool illustrated in FIGS. 1–5, taken along line 8—8 of FIG. 2.

As shown in FIGS. 1, 2, 4 and 7, the lower portion 56*a* of the housing 48*a* is attached to an upper tube 60*a* (via securing members 62*a* and adjustable clamp 64*a*), and the upper tube 60*a* includes a slot 66*a* (see FIGS. 1 and 8). As shown in FIG. 7, a collar 68*a* is secured to the lower portion 56*a* of the housing 48*a* (via securing members 62*a*) and engages an end 70*a* of a spring 72*a* disposed in the upper tube 60*a*. As shown in FIG. 8, collar and guide structure 74*a* is preferably disposed on the collar 68*a*, and the spring 72*a* extends through the upper tube 60*a* and engages a top surface 76*a* of a lower tube 80*a*. Specifically, 74A in FIG. 8 points to two different components. The upper component is a collar that is pressed onto the shaft 114*a*, and does not move. The lower component is a "guide" that slides along the shaft 114*a* but has threads on its outside diameter and is threaded onto the collar 68*a*. The spring 72*a* serves to return the drive tool 20*a* to its starting position in use.

As shown in FIGS. 1, 4 and 7, a stop bracket 82*a* is attached to the feed tube 44*a* (via wing nut 84*a*), and is secured to the lower tube 80*a* and a bottom tube cap 86*a* (via securing members 88*a*). Preferably, as shown in FIGS. 1 and 4, the feed tube 44*a* is also connected to the lower tube 80*a* via an adjustable bracket 90*a*. The adjustable bracket 90*a* may provide that the length of travel of the drive tool 20*a* (during operation) can be adjusted. Alternatively, a torque clutch (i.e., a slip clutch) can be provided.

As shown in FIGS. 1, 2, 4 and 10, the lower tube 80*a* extends from an opening 92*a* in the bottom end 94*a* of the upper tube 60*a* such that the lower tube 80*a* essentially telescopes from the opening 92*a*. Specifically, the lower tube 80*a* extends from the opening 92*a* in the upper tube 60*a* and is moveable relative to the upper tube 60*a* during a drilling operation. This will be described more fully herein.

As shown in FIG. 10, the foot pad bracket 32*a* is secured to the bottom of the lower tube 80*a* via securing member 96*a* and button head screw 98*a*. As shown in FIGS. 1, 4 and 10, a shuttle 100*a* effectively connects the lower end of the gravity feed tube 44*a* to the lower tube 80*a*. Preferably, the button head screw 98*a* connects to a nosepiece or end piece 104*a*, and provides that the end piece 104*a* can be relatively easily removed from the lower tube 80*a* and replaced. The end piece 104*a* ultimately receives the fasteners from the feed tube 44*a* (see FIG. 10), and the fasteners 28 exit an opening 106*a* in the end 42*a* of the end piece 104*a* when they are installed using the drive tool 20*a*. As shown (see, for example, FIGS. 1, 2 and 4), preferably the opening 106*a* includes four slots 108*a* which allow "chip relief" (i.e., allow chips to escape from under the drill tool 20*a* during drilling).

Figure 9:
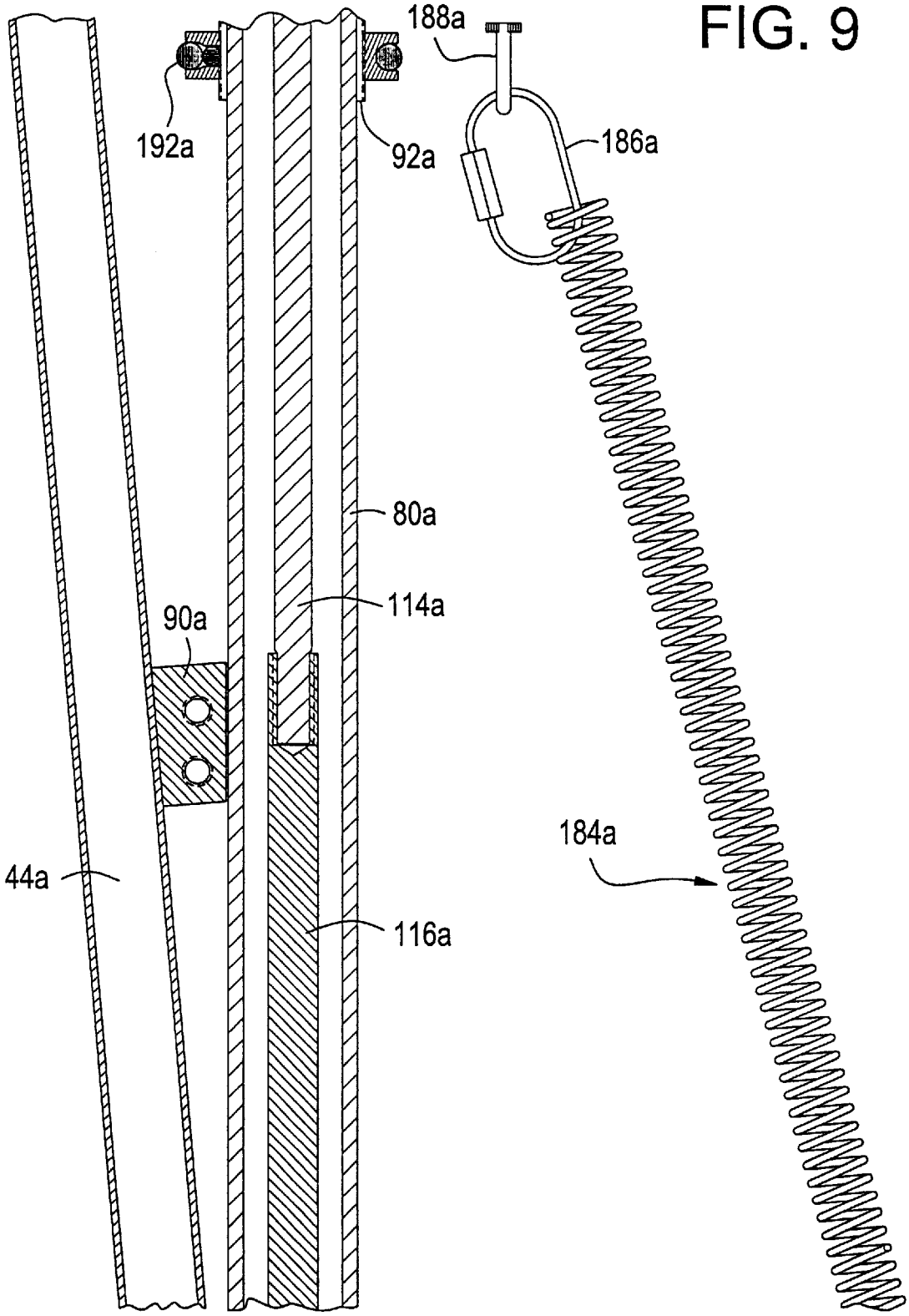
FIG. 9 is a cross-sectional view of the drive tool illustrated in FIGS. 1–5, taken along line 9—9 of FIG. 2.

As discussed above, the housing 48*a* at the top of the drive tool 20*a* has an opening 50*a* configured for receiving a drive source 24, such as the rotating, driven end of a power drill. As shown in FIG. 7, the drive source 24 engages an adaptor 112*a* in the housing 48*a*, and the adaptor 112*a* engages a shaft 114*a* that extends along a substantial length of the drive tool 20*a*. The shaft 114*a* extends from the adaptor 112*a*, through the collar 68*a*, through the spring 72*a*, through the bottom tube cap 86*a*, and is engaged, at its end, with an extension 116*a*. As shown in FIGS. 9 and 10, the extension 116*a* engages a drive bit 164*a* or nut driver in the end piece 104*a*, and the drive bit 164*a* engages the fastener 28 to be installed using the drive tool 20*a*. Preferably, a retaining ring 166*a* and ball bearing 168*a* retain the drive bit 164*a* with the end of the shaft 114*a*. A pair of set screws may also be provided to retain the drive bit 164*a* to the end of the shaft 114*a*. Preferably, the engagement is such that the drive 164*a* bit can be easily replaced. Although the shaft 114*a* is shown engaged with an extension 116*a*, the extension 116*a* could be omitted, in such case the shaft 114*a* would be longer than depicted in the FIGURES and would engage directly with the drive bit 164*a*.

As shown in FIG. 10, the shuttle 100*a* provides a passageway 170*a* extending between the gravity feed tube 44*a* and the end piece 104*a*, and the passageway 170*a* provides that a fastener 28 can travel from the gravity feed tube 44*a* to the end piece 104*a*. Preferably, a fastener retaining structure 172*a* is provided in the end piece 104*a* for engagement with the fastener 28 when the fastener 28 is disposed in the end piece 104*a*. Specifically, the fastener retaining structure 172*a* may comprise an o-ring 174*a* and steel ball 176*a*. Preferably, the fastener retaining structure 172*a* allows any unwanted fasteners in the end piece 104*a* to be easily removed.

As shown in FIGS. 1, 3, 4, 5, 9 and 10, the foot pad 30*a* is preferably spring-connected to the upper tube 60*a*. Specifically, preferably a ring 180*a* is connected to the foot pad 30*a*, and the ring 180*a* engaged with a removable ring 182*a* that is engaged with a spring 184*a* (the spring 184*a* is represented by a dashed line in FIGS. 3 and 6). The opposite end of the spring 184*a* is engaged with another removable ring 186*a* that is engaged with a ring 188*a* that is secured to an upper bracket 190*a* on the upper tube 60*a*. The upper bracket 190*a* is threaded to the upper tube 60*a* and is further retained thereon by a set screw 191*a*. Additionally, nut 192*a* effectively retains the upper bracket 190*a* on the upper tube 60*a*. The fact that the foot pad 30*a* is spring-connected to the bracket 190*a* serves the purpose of generally preventing the foot pad 30*a* from simply dropping down when the drill tool 20*a* is lifted as it is positioned for the next fastener. Otherwise, the drive tool 20*a* would be relatively difficult to maneuver between fastenings.

As shown in FIGS. 1 and 2, a lower bracket 194*a* is secured to the lower tube 80*a*, and a pair of rods 200*a*—one on each side of the drive tool 20*a*—are attached to the lower bracket 194*a*. The rods 200*a* are generally parallel to the upper and lower tubes, 60*a* and 80*a*, and extend upward, and through the upper bracket 190*a* to which the spring 184*a* is effectively attached. Preferably, each of the rods 200*a* is threaded or at least includes a threaded portion such that a nut 202*a* and washer 204*a* are engaged with each rod 200*a*. As shown in FIGS. 1–5, each rod 200*a* carries a spring 210*a*, and each spring 210*a* is disposed between the upper bracket 190*a* and the washer 204*a* on the rod 200*a*. Preferably, the nuts 202*a* can be adjusted along the lengths of the rods 200*a*, and this provides that the initial compression of the springs 210*a* can be adjusted.

Because the rods 200*a* are effectively attached to the lower tube 80*a* (via lower bracket 194*a*), when an operator places the end piece 104*a* of the drive tool 20*a* onto the floor and steps on the foot pad 30*a*, his or her body weight forces the rods 200*a* to travel downward. As the rods 200*a* travel downward, the washers 204*a* compress the springs 210*a*, and the springs 210*a* exert a force against the upper bracket 190*a*. Since the upper bracket 190*a* is secured to the upper tube 60*a*, this compression pushes the upper tube 60*a* downward and applies an end load to the fastener. Hence, an operator can install a fastener using his or her body weight (by applying same to the foot pad 30*a*) without having to employ a substantial amount of upper-body axial force.

Typically, a fastener will require a given end load in order to successfully drill through and form threads. Preferably, the load/deflection design of the springs 210*a* is such that the springs 210*a* exert the required amount of load generally uniformly throughout the length of travel needed for the drilling sequence. The springs 210*a* then preferably maintain sufficient load (albeit preferably somewhat less) after the drilling sequence to allow the thread forming sequence to occur.

Preferably, the drive tool 20*a* is configured such that the length of travel, during operation, of the drive tool 20*a* is adjustable to accommodate different length screws. This can be performed by changing the position of screws 212*a* (see, for example, FIG. 3) that go into the bracket 90*a* secured to the feed tube 44*a*. Preferably, the adjustment can be made in 0.5 inch increments. Additional fine tuning can be effected by turning nut 192*a* to which the upper bracket 190*a* is affixed. This additional fine tuning is needed in case it is required to manually disengage the socket from the head of the fastener.

To use the drive tool 20*a* to drive a fastener 28 into a work piece, an operator engages a drive source 24 with the end 52*a* of the housing 48*a*. Then, the operator drops one or more fasteners 28 into the gravity feed tube 44*a*. Preferably, the operator drops a fastener 28 having a flange thereon 220 as shown in FIG. 10. Specifically, the fastener 28 may be a self-drilling fastener, such as a fastener consistent with that which is shown and described in U.S. Pat. No. 5,605,423, which is incorporated herein in its entirety by reference.

The fastener 28 moves from the gravity feed tube 44*a*, through the passageway 170*a* in the shuttle 100*a*, and into the end piece 104*a*, to the position shown in FIG. 10. As shown, preferably the fastener 28 drops into a position such that the lower flange 220 on the fastener 28 contacts the steel ball 176*a* in the end piece 104*a*. The steel ball 176*a* prevents the fastener 28 from exiting prematurely from the opening 106*a* of the end piece 104*a*, and positions the fastener for engagement by the socket and prevents the fastener from sticking out of the nosepiece prematurely.

Thereafter, the operator manipulates the drive tool 20*a* such that the end of the fastener 28 is disposed against the work piece, at the location at which the operator wants to install the fastener 28. Then, the operator steps on the foot pad 30*a* and operates the drive source 24 to cause the adaptor 112*a*, shaft 114*a* and drive bit 164*a* to rotate. When the operator stands on the foot pad 30*a*, the outer edge 36*a* of the foot pad 30*a* pivots downward (i.e., the foot pad 30*a* pivots about axis 34*a*) and contacts the floor. The other edge 38*a* of the foot pad 30*a* preferably drops down close to the floor, but preferably does not touch the floor. Because the rods 200*a* are effectively attached to the lower tube 80*a* (via lower bracket 194*a*), when an operator places the end piece 104*a* of the drive tool 20*a* onto the floor and steps on the foot pad 30*a*, his or her body weight forces the rods 200*a* to travel downward. As the rods 200*a* travel downward, the washers 204*a* compress the springs 210*a*, and the springs 210*a* exert a force against the upper bracket 190*a*. Since the upper bracket 190*a* is secured to the upper tube 60*a*, this compression pushes the upper tube 60*a* downward and the upper tube 60*a* telescopes downwardly over the lower tube 80*a*. The combination of the spring-loaded force and the operator force on the foot pad 30*a* of the drive tool 20*a* causes the drive tool 20*a* to apply an end load to the fastener, thereby forcing the fastener 28 beyond the steel ball 176*a* in the end piece 104*a*, and driving the fastener 28 into the work piece. Hence, an operator can use the drive tool 20*a* to install a fastener using his or her body weight (on the foot pad 30*a*), without having to employ a substantial amount of upper-body axial force.

While the fastener 28 is being driven into the work piece, the compression of the springs 210*a* imparts an axially directed force along the shaft 114*a*. Hence, the structure provides an axial load assist mechanism that effectively reduces the amount of upper-body axial force an operator must apply to the drive tool 20*a*. Hence, the operator can use the drive tool 20*a* to install fasteners more quickly and with less effort. Preferably, the springs 210*a* create a generally constant axial spring load throughout the drilling and thread forming process. Additionally, during drilling and tapping, preferably a constant force is kept on the fastener. Preferably, the springs 210*a* apply a constant axial load resulting in fast drill and tapping times.

Once the fastener has been driven into the work piece, the operator can step off the foot pad 30*a* and the drive tool 20*a* will return to the starting position (due to the force of the spring 72*a*). At this point, another fastener 28 is fed to the end piece 104*a* from the gravity feed tube 44*a*.

The drive tool 20*b* shown in FIGS. 11–12 is similar to the drive tool 20*a* shown in FIGS. 1, 2 and 4, and hence, like drive tool 20*a*, includes, among other parts, a foot pad 30*b*, an automatic fastener feeding mechanism 40*b*, a housing 48*b*, an upper tube 60*b*, a lower tube 80*b*, a shuttle 100*b*, an end piece 104*b* and a spring 184*b*. In fact, the only major difference between the drive tool 20*b* shown in FIGS. 10–12 and the drive tool 20*a* shown in FIGS. 1, 2 and 4 is that instead of including springs on rods on each side of the drive tool, as is provided on drive tool 20*a*, the drive tool 20*b* shown in FIGS. 11–12 includes a single spring 240*b* which is retained on the lower tube 80*b*, between a ring 242*b* and an adjustable nut 244*b*. Ring 242*b* is adjustable up or down, and serves as a stop for the spring 240*b*. Operation of the drive tool 20*b* is effectively the same as operation of the drive tool 20*a* already described except that when an operator steps on the foot pad 30*b*, the single spring 240*b* compresses between the ring 242*b* and nut 244*b* to provide an axial assist mechanism that obviates the need for the operator to employ a substantial amount of upper-body force to effect a drilling operation. As shown, the drive tool 20*b* does include rods 200*b* on each side of the drive tool 20*b*, but, unlike the rods 200*a* of drive tool 20*a*, do not carry springs which compress when an operator steps on the foot pad 30*b*.

Although not shown in the FIGURES, either one of the drive tools 20*a*, 20*b* can be provided with wheels for facilitating the transportation of the tool—both between fastenings at a given site and from one site to another.

While embodiments of the present invention are shown and described, it is envisioned that those skilled in the art may devise various modifications without departing from the spirit and scope of the appended claims.

What is claimed is:

1. A drive tool engageable with a drive source and a fastener, said drive tool comprising: a top portion which is engageable with the drive source; a lower portion which is engageable with the fastener, said drive tool including at least one spring which is configured to urge the lower portion and upper portion of the tool away from each other and at least one spring which is configured to provide that a generally axial force is applied to the fastener which is engaged with the lower portion of the tool.

2. A drive tool as recited in claim 1, wherein said drive tool is configured such that an operator need not apply any upper-body axial force to the drive tool to install the fastener.

3. A drive tool as recited in claim 1, wherein said lower portion of the drive tool includes at least one foot pad.

4. A drive tool as recited in claim 3, wherein said at least one foot pad is pivotable.

5. A drive tool as recited in claim 3, wherein said at least one foot pad is spring-connected to a portion of the drive tool.

6. A drive tool as recited in claim 3, wherein the drive tool is configured such that said at least one spring compresses when an operator stands on the at least one foot pad.

7. A drive tool as recited in claim 1, said drive tool configured such that compression of said at least one spring results in a generally axial force being applied to the fastener engaged with the lower portion of the tool.

8. A drive tool as recited in claim 1, further comprising a handle on the top portion of the drive tool and a foot pad on the lower portion of the tool.

9. A drive tool as recited in claim 1, further comprising an automatic fastener feeding mechanism in communication with the lower portion of the drive tool and configured to feed fasteners to the lower portion of the drive tool.

10. A drive tool as recited in claim 9, said automatic fastener feeding mechanism comprising a gravity feed tube which includes a funnel end piece.

11. A drive tool as recited in claim 1, further comprising a spring generally contained in the drive tool.

12. A drive tool as recited in claim 1, further comprising an adjustable bracket on the drive tool, said adjustable bracket configured to provide that a length of travel of the drive tool during use is adjustable.

13. A drive tool as recited in claim 1, further comprising an end piece having at least one chip relief slot.

14. A drive tool as recited in claim 1, further comprising an end piece and fastener retaining structure in the end piece.

15. A drive tool as recited in claim 1, further comprising at least one rod, said at least one spring disposed on said rod.

16. A drive tool as recited in claim 1, further comprising a pair of rods, said at least one spring comprising a spring disposed on each rod.

17. A drive tool as recited in claim 1, further comprising a lower bracket engaged with the lower portion of the drive tool, an upper bracket engaged with the upper portion of the drive tool, at least one rod extending from said lower bracket and through said upper bracket to an end of said rod, said at least one spring disposed on said rod generally between said upper bracket and said end of said rod.

18. A drive tool as recited in claim 17, wherein said lower portion of the drive tool includes at least one foot pad, wherein said at least one foot pad is spring-connected to said upper bracket.

19. A drive tool as recited in claim 1, further comprising a lower bracket engaged with the lower portion of the drive tool, an upper bracket engaged with the upper portion of the drive tool, a pair of rods extending from said lower bracket and through said upper bracket, said at least one spring comprising a spring disposed on each rod, generally between said upper bracket and a respective end of said rod.

20. A drive tool as recited in claim 19, wherein said lower portion of the drive tool includes at least one foot pad, wherein said at least one foot pad is spring-connected to said upper bracket.

21. A drive tool as recited in claim 1, further comprising a tube, a ring on said tube and a nut on said tube, a lower bracket engaged with the lower portion of the drive tool, an upper bracket engaged with the upper portion of the drive tool, a pair of rods extending from said lower bracket and through said upper bracket, said at least one spring disposed on said tube between said ring and said nut.

* * * * *